US007934405B2

(12) United States Patent
Burmesch et al.

(10) Patent No.: US 7,934,405 B2
(45) Date of Patent: May 3, 2011

(54) COMBINATION PADLOCK

(75) Inventors: Gary Burmesch, Port Washington, WI (US); Eric Mackey, Milwaukee, WI (US); Jesse Marcelle, Muskego, WI (US); Zachery Nave, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 473 days.

(21) Appl. No.: 12/015,185

(22) Filed: Jan. 16, 2008

(65) Prior Publication Data

US 2008/0173049 A1 Jul. 24, 2008

Related U.S. Application Data

(60) Provisional application No. 60/880,611, filed on Jan. 16, 2007, provisional application No. 60/975,902, filed on Sep. 28, 2007.

(51) Int. Cl.
*E05B 37/02* (2006.01)

(52) U.S. Cl. ..... 70/25; 70/295; 70/303 A; 70/312; 70/314; 70/322; 70/332; 70/386

(58) Field of Classification Search ..... 70/386, 70/22, 24–29, 295, 301, 302, 303 R, 303 A, 70/314–318, 312, 321, 322, 332
See application file for complete search history.

(56) References Cited

U.S. PATENT DOCUMENTS 548,757 A 10/1895 Kellog
1,310,634 A 7/1919 Rozycki
1,607,758 A 10/1926 Junkunc
1,703,193 A 2/1929 Jacobi
1,719,637 A 7/1929 Werner
1,743,331 A 1/1930 Ellison
1,866,273 A 7/1932 Sinner
2,116,965 A * 5/1938 Schoorel et al. ..... 70/38 A
2,132,201 A 10/1938 Allman
2,673,457 A 3/1954 Miller (Continued)

FOREIGN PATENT DOCUMENTS

GB 2229220 9/1990

OTHER PUBLICATIONS

International Search Report and Written Opinion from International Application No. PCT/US2008/051158, mailed Aug. 11, 2008.

*Primary Examiner* — Lloyd A Gall
(74) *Attorney, Agent, or Firm* — Calfee, Halter & Griswold LLP

(57) ABSTRACT

A combination lock includes a lock body, a shackle axially moveable between a retracted position and an extended position, a locking mechanism, and a dial secured to the front side of the lock body. The locking mechanism is movable from a locked condition to an unlocked condition to permit movement of the shackle from the retracted position to the extended position. The dial includes an outer ring portion surrounding a stationary lock body face and rotatable with respect to the face, and a locking mechanism engaging portion disposed between the lock body face and the rear side of the lock body, wherein successive rotation of the dial to a series of one or more predetermined rotational positions causes the locking mechanism to move from the locked condition to the unlocked condition.

25 Claims, 17 Drawing Sheets

U.S. PATENT DOCUMENTS

| | | | | | |
|---|---|---|---|---|---|
| 2,775,112 | A | | 12/1956 | Taylor | |
| 2,780,087 | A | * | 2/1957 | Miller | 70/51 |
| 2,830,447 | A | | 4/1958 | Miller | |
| 2,852,928 | A | | 8/1958 | Miller | |
| 2,931,204 | A | | 4/1960 | Check | |
| 3,349,584 | A | | 10/1967 | Russell et al. | |
| 3,533,253 | A | | 10/1970 | Miller et al. | |
| 3,720,083 | A | | 3/1973 | Wellekens | |
| 3,894,415 | A | | 7/1975 | Bako | |
| 3,952,559 | A | | 4/1976 | Atkinson | |
| 4,014,191 | A | | 3/1977 | Harrington et al. | |
| RE29,277 | E | | 6/1977 | Harrington et al. | |
| 4,170,884 | A | * | 10/1979 | Calegan | 70/21 |
| 4,236,394 | A | | 12/1980 | Harrington | |
| 4,422,311 | A | | 12/1983 | Zaabel et al. | |
| 4,476,698 | A | | 10/1984 | Treslo | |
| D276,408 | S | | 11/1984 | Zabel et al. | |
| 4,722,207 | A | | 2/1988 | Wertz, Jr. | |
| 4,730,467 | A | | 3/1988 | Lebrecht | |
| 5,953,940 | A | * | 9/1999 | Ling | 70/25 |
| 6,298,694 | B1 | | 10/2001 | Knoll | |
| 6,425,274 | B1 | | 7/2002 | Laitala | |
| 6,442,983 | B1 | | 9/2002 | Thomas et al. | |
| 7,117,698 | B2 | | 10/2006 | Lai | |
| 7,251,965 | B2 | | 8/2007 | Yu | |
| 2002/0046584 | A1 | | 4/2002 | Lumpkin | |
| 2003/0196461 | A1 | | 10/2003 | Liou | |
| 2003/0205069 | A1 | | 11/2003 | Knoll | |
| 2004/0093914 | A1 | | 5/2004 | Vito | |
| 2007/0220929 | A1 | | 9/2007 | Green | |
| 2008/0314093 | A1 | | 12/2008 | Nave | |
| 2009/0113947 | A1 | | 5/2009 | Lai | |
| 2009/0145178 | A1 | | 6/2009 | Nave | |

* cited by examiner

COMBINATION PADLOCK

CROSS REFERENCE TO RELATED APPLICATIONS

This application claims the benefit of both U.S. patent application Ser. No. 60/880,611, entitled COMBINATION PADLOCK and filed Jan. 16, 2007, and U.S. patent application Ser. No. 60/975,902, entitled COMBINATION PADLOCK and filed Sep. 28, 2007, the entire disclosures of both of which are incorporated herein by reference, to the extent that they are not conflicting with the present application.

BACKGROUND OF THE INVENTION

Combination padlocks are used in a variety of applications, including, for example, with enclosures such as lockers, storage sheds, and various gates and doors. The locking mechanism of a conventional single dial combination lock 1 is illustrated in FIG. 1. A numbered combination dial 2, which serves as the user interface, is positioned on an external surface of the lock 1. Rotation of the dial causes a drive cam 3 to engage a series of rotating cams 4*a*, 4*b*, 4*c* (usually three for a conventional combination padlock or school locker), each having an outer periphery which holds a latch or fence 7 in a locking condition. Detents 9 extending from each of the cams 4*a*, 4*b*, 4*c* engage each other to cause the cams 4*a*, 4*b*, 4*c* to rotate together. When the dial 2 is rotated to a first desired rotational position and then rotated in an opposite direction (for example, the counterclockwise direction), the first cam 4*a* remains in a desired rotational position due to separation from the detent 9 of the second cam 4*b*. When the dial is then rotated to a second desired rotational position and then rotated in an opposite direction (for example the clockwise direction), the second cam 4*b* remains in a desired rotational position due to separation from the detent 9 of the third cam 4*c*. When the dial 2 is then rotated to a third desired rotational position, the third cam 4*c* is positioned accordingly. In this fashion, the dial 2 may be rotated to successive desired positions (identified by the numbers on the dial 2) that align notches 6 in each of the cams 4*a*, 4*b*, 4*c* with the fence 7. When all of the notches 6 are aligned with the fence 7, the fence may be permitted to move into the aligned notches 6 (for example, by user movement or by a spring loaded mechanism), allowing a locking member 5 to move out of locking engagement with a locked obstruction, such as, for example, a shackle, in the case of a combination padlock, or a locker door, in the case of a combination locker lock.

While the use of a combination lock, as compared to a key based lock, may eliminate the risk of lost, stolen, or copied keys, an authorized combination may still be learned by an unauthorized user, or known by a once-authorized user to whom access is no longer desired. In these and other circumstances, an authorized user may wish to change the unlocking combination.

A conventional combination padlock is maintained in a locked condition by a latch that engages one leg of a shackle. Such a lock may be susceptible to tampering by rapping or shimming the latch out of engagement with the shackle to open the lock. As another characteristic of a conventional combination padlock, the internal cams rotated to an authorized combination to open the lock may remain at or near this authorized combination upon re-locking the lock, thereby potentially compromising lock security. As still another characteristic of a conventional combination padlock, the combination dial is controlled by a relatively small knob that may be ergonomically difficult to manipulate. Further, when dialing the combination on a conventional combination padlock, rapid revolution of the numbers on the dial may cause the numbers to visually wash together, making it difficult to accurately rotate the dial to the proper position without slowing rotation of the dial in order to view the numbers.

SUMMARY

The present application describes various inventive features that may be provided with a locking arrangement, such as, for example, a combination padlock. According to one inventive aspect of the present application, a combination lock may be provided with a dial having a ring shaped portion that surrounds and is rotatable about a stationary front face of the lock body having one or more rotational position indicia for indicating the rotational position of the dial. According to another inventive aspect of the present application, a combination lock may be provided with a combination code reset feature, which may include a camming member that is pivotable to a reset position to separate dial-driven hubs from corresponding unlocking wheels, such that the rotational position of the hubs with respect to the wheels may be adjusted. According to yet another inventive aspect of the present application, a combination padlock may be provided with a sliding member configured to hold a locking member in locking engagement with a corresponding notch in a shackle when the sliding member is in a locked position, and further configured to allow the locking member to disengage from the shackle when the sliding member is in an unlocked position, to permit movement of the shackle from a retracted position to an extended position. According to still another inventive aspect of the present application, a combination padlock may be provided with an upset member assembled with a long leg of a shackle, the upset member being configured to be spring loaded against one of a plurality of rotatable cams as the shackle is moved from an extended position to a retracted position, such that the spring-loaded upset member imparts a rotational force on the one of the plurality of cams when the shackle reaches the retracted position to rotate the plurality of cams out of an unlocking orientation.

Accordingly, in one embodiment, a combination lock includes a lock body, a shackle axially moveable between a retracted position and an extended position, a locking mechanism, and a dial secured to the front side of the lock body. The locking mechanism is movable from a locked condition to an unlocked condition to permit movement of the shackle from the retracted position to the extended position. The dial includes an outer ring portion surrounding a stationary lock body face and rotatable with respect to the face, and a locking mechanism engaging portion disposed between the lock body face and the rear side of the lock body, wherein successive rotation of the dial to a series of one or more predetermined rotational positions causes the locking mechanism to move from the locked condition to the unlocked condition.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

This Detailed Description of the Invention merely describes embodiments of the invention and is not intended to limit the scope of the claims in any way. Indeed, the invention as claimed is broader than and unlimited by the embodiments described herein, and the terms used in the claims have their full ordinary meaning.

According to an inventive aspect of the present application, a combination padlock may be provided with a dial having an outer ring portion rotatable about a stationary front face of the lock. In one embodiment, one or more rotational position indicia (such as sequential numbers) may be provided on the stationary face of the lock, and an indicator marking may be provided on the dial, such that the dial may be rotated to align the indicator marking with one of the rotational position indicia corresponding with a proper dial position (either alone or as one of a sequence of dial positions) for unlocking the lock. In some embodiments, the width of the indicator marking may correspond with the required precision of the incremental dial position. For example, a wide or thick indicator marking may be provided with a combination lock requiring less precision in the incremental rotational positions of the dial required to unlock the lock.

Figure 2:
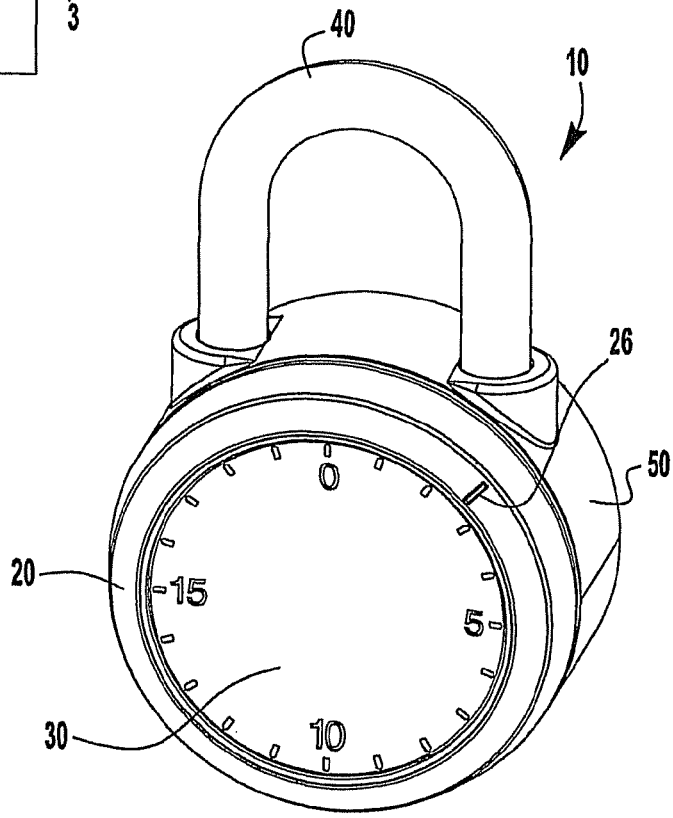
FIG. 2 illustrates a front perspective view of a combination padlock.

Referring to FIG. 2, an exemplary combination padlock 10 includes a dial 20 that is rotatable about a stationary front face 30 of the lock 10. The dial 20 may be rotated to one or more of a series of rotational positions to operate a locking mechanism, to allow axial movement of the shackle from a retracted position to an extended position, such that the short leg of the shackle 40 may be disengaged or withdrawn from the lock body 50 to open the padlock 10. The long and short legs of the shackle 40 are received in corresponding first and second shackle openings in an outer periphery of the lock body 50, between the front and rear sides of the lock body.

Figure 3A:
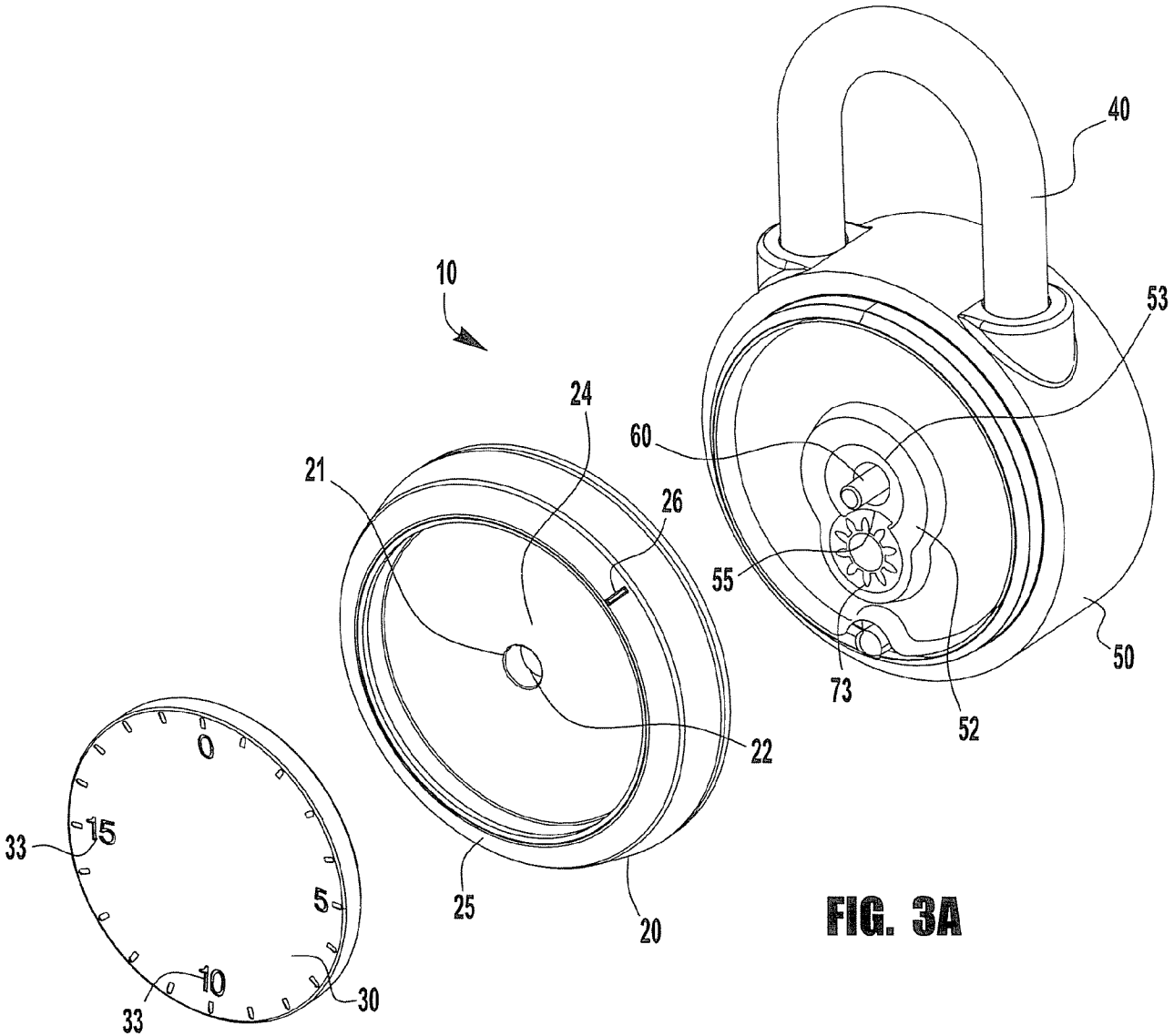
FIG. 3A illustrates a partially exploded front perspective view of the combination padlock of FIG. 2.
Figure 3B:
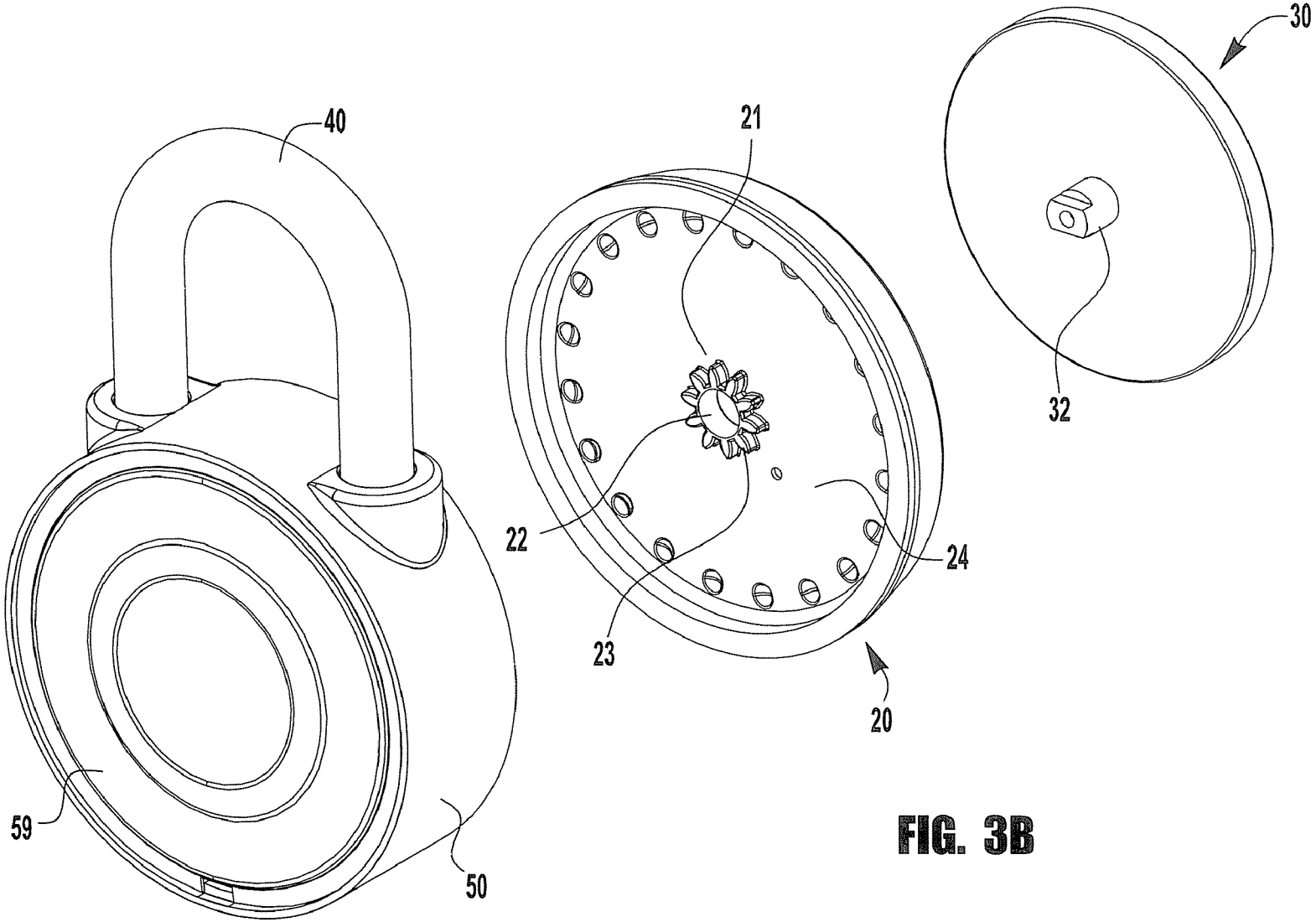
FIG. 3B illustrates a partially exploded rear perspective view of the combination padlock of FIG. 2.

Many different configurations may be used to provide a ring-shaped dial that rotates about a stationary face on a combination lock. In one embodiment, a dial includes a center or locking mechanism engaging portion configured to connect with a locking mechanism of the combination padlock, such as, for example, a stacked cam locking arrangement. In such an embodiment, the stationary face of the lock may be affixed to a central portion of the lock body through an opening in the center portion of the dial. In an exemplary embodiment, as illustrated in FIGS. 3A and 3B, the dial 20 includes a center portion 21 having an opening 22 therethrough. A fastener 60, such as a post or screw, extends from the lock body 50 through the opening 22 to attach to a mounting portion 32 on the rear side of the stationary face 30 to a central hub portion 52 on the lock body 50. Using such an arrangement, as the dial 20 is rotated, the face portion 30 remains stationary, which may, for example, provide enhanced visibility of the rotational position indicia 33 (e.g., incrementally numbered hatch marks). To dial a desired combination, a marking 26 on the outer ring portion of the dial 20 may be aligned with the authorized combination reference (such as a number of indicia 33). The dial 20 may further include a cover portion 25, which may be molded over or otherwise attached to the outer, exposed ring shaped portion of the dial 20. The cover portion 25 may, for example, be provided in a plastic or elastomer material to provide a tactile gripping surface for the user.

While the center portion 22 of the illustrated dial 20 is supported at the center of a cross-shaped frame portion 24, many different configurations of dials may be used, taking into consideration factors such as material usage, durability, and manufacturability. As one example, a combination lock may utilize a solid disk-shaped dial with central opening.

The types of locking mechanisms utilized in a combination padlock may be limited by the space within the lock body to accommodate the lock components. According to another inventive aspect of the present application, a stack of dial cams associated with a combination lock arrangement may be offset from the center of the lock body to provide additional space near the ends of the shackle legs for locking members to engage the shackle, which may allow for a more durable or tamper resistant locking engagement with the shackle. In one embodiment, the offset cam stack may be gear driven by a central gear. In the illustrated embodiments, the dial 20 includes a gear member 23 on a rear side of the central portion 22. The gear member 23 is positioned to be received in a recess 53 in the lock body hub 52, such that the gear member 23 engages a gear portion 73 rotatable about a post 58 extending from a back plate 59 at the rear side of the lock body 50. The gear portion 73 extends through an opening 55 in the lock body 50 to axially align with the gear member 23. The engagement of the gear member 23 with the gear portion 73 translates rotation of the gear member 23 to a series of dial cams 70, 74, 76, which rotate about the post 58. In the exemplary embodiment, the gear portion 73 is integral with the first dial cam 70. The offset position of the dial cams 70, 74, 76 and post 58 with respect to the central axis of the dial 20 provides space to accommodate a locking mechanism, such as the locking member subassembly 80 of the illustrated embodiments, described in greater detail below.

Figure 8A:
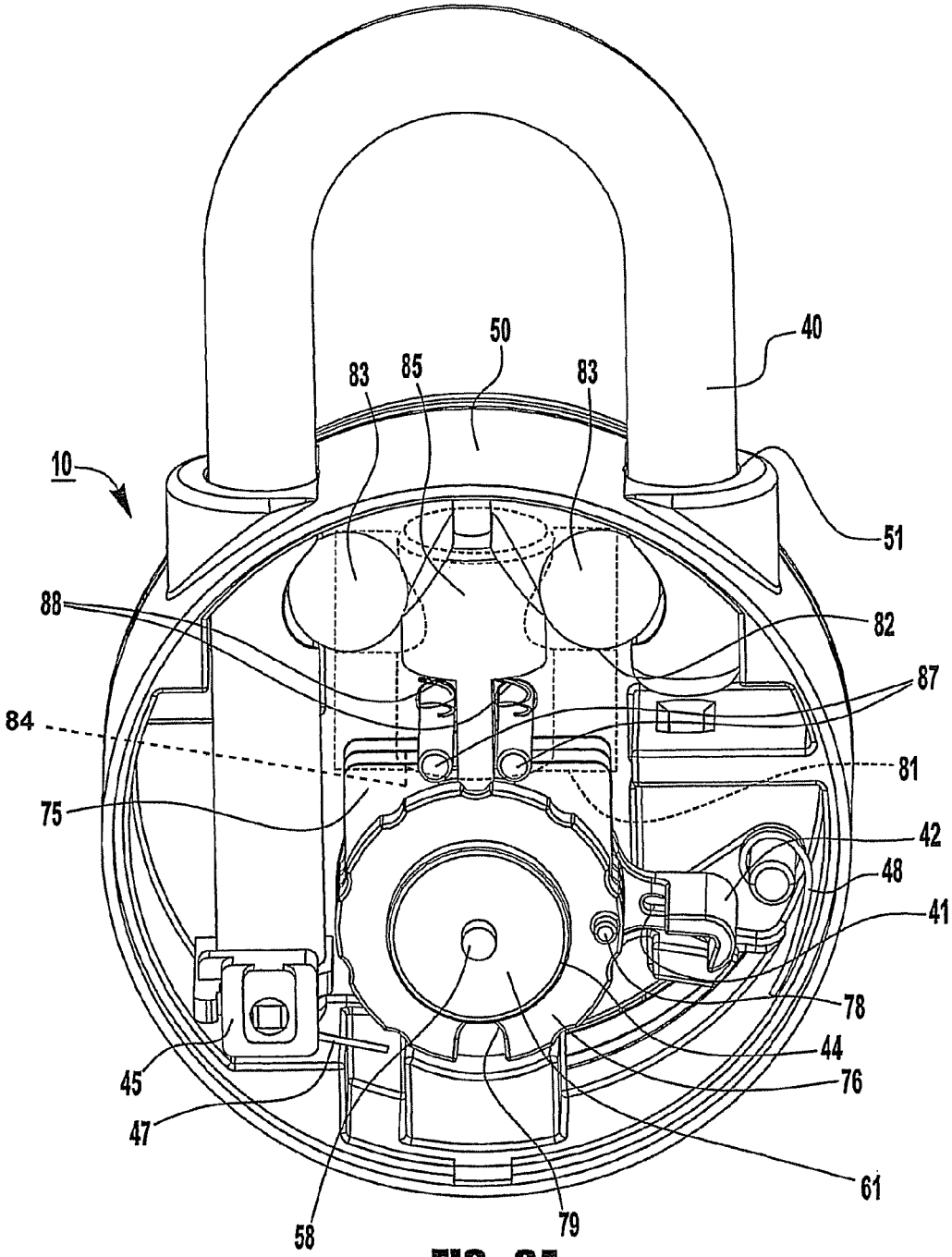
FIG. 8A illustrates a rear cross-sectional perspective view of the combination padlock of FIG. 2, shown in a locked condition.
Figure 8B:
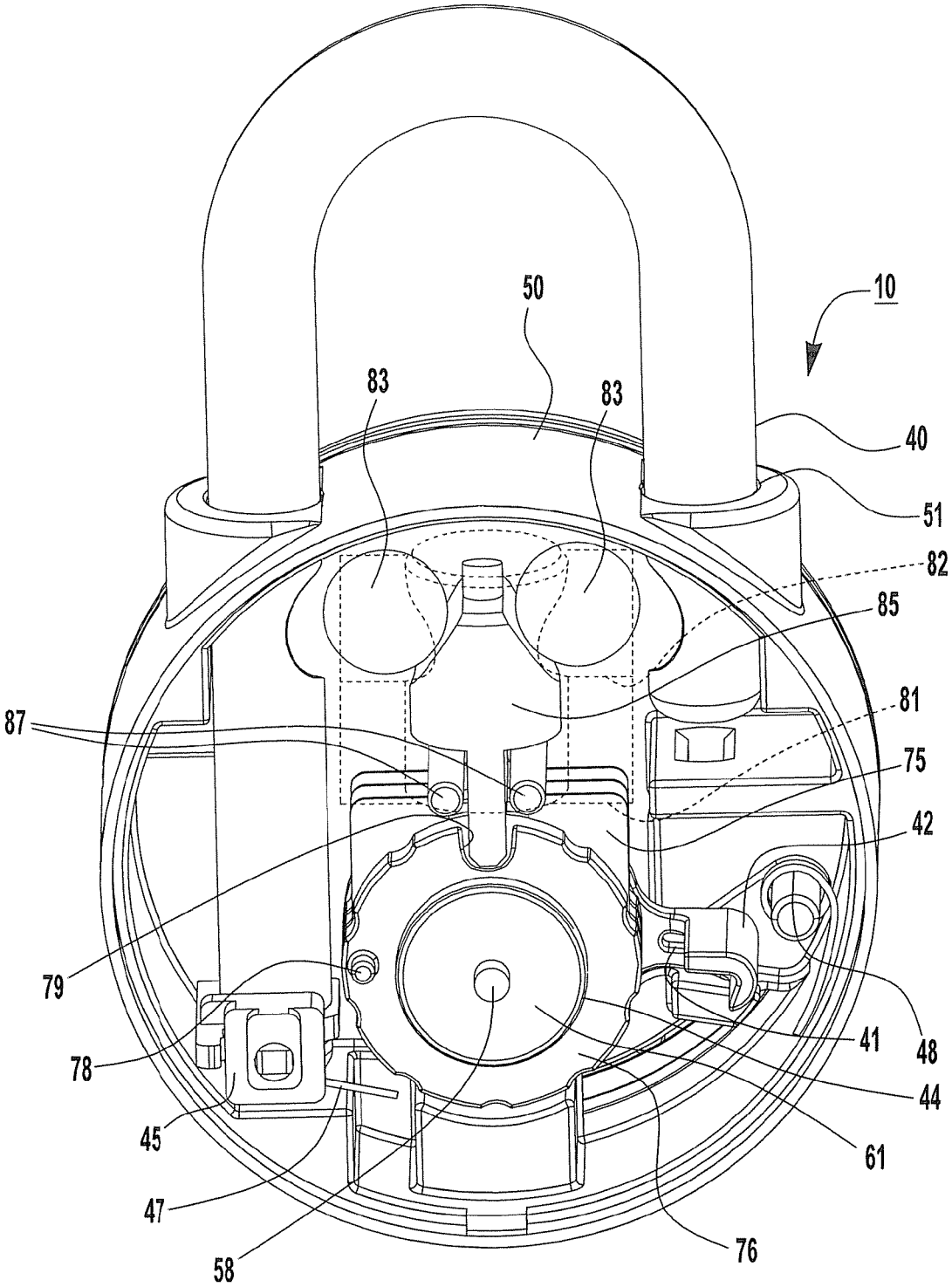
FIG. 8B illustrates a rear cross-sectional perspective view of the combination padlock of FIG. 2, shown in an unlocking condition.
Figure 8C:
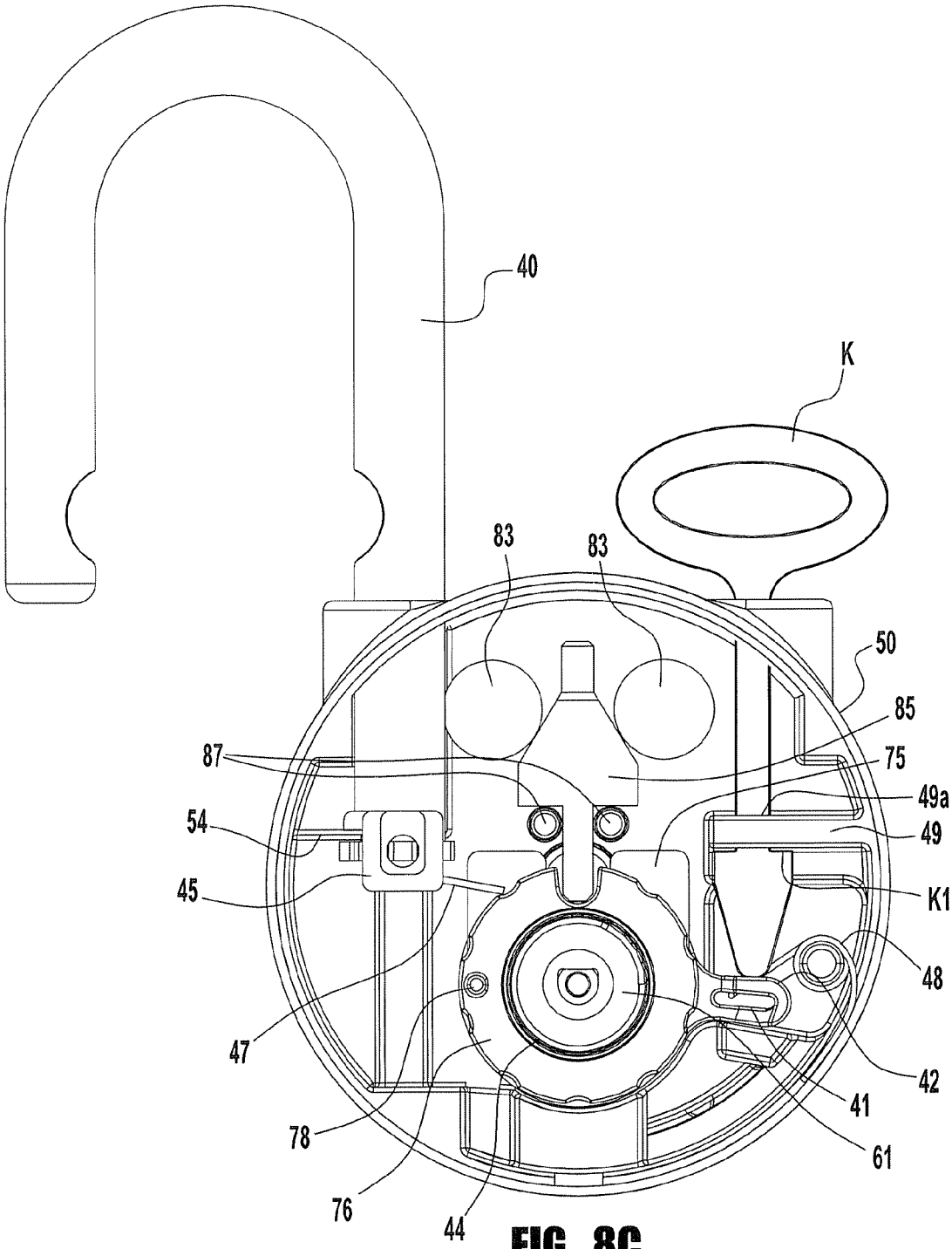
FIG. 8C illustrates a rear cross-sectional perspective view of the combination padlock of FIG. 2, shown in a combination resetting condition.

Many different dial cam arrangements may be utilized. In the illustrated embodiment, rotation of the dial 20 causes gear member 23 to engage a series of rotating cams or wheels 70, 74, 76 through gear portion 73. Detents 77 extending from each of the cams 70, 74, 76 engage each other to cause the cams to rotate together. A sliding member or plunger 85 (or latch, fence, or other such movable component) as illustrated in FIGS. 8A-8C, is forced into a locked position by an outer periphery of the cams 70, 74, 76. By rotating the dial 20 to successive predetermined positions identified by the numbers on the stationary face 30 (i.e., the lock access combination), a notch or recess 79 (or some other unlocking feature) in each of the cams 70, 74, 76 is brought into alignment with the plunger 85. When all of the recesses 79 are aligned with the plunger 85, the plunger is permitted to move into or engage the aligned recesses 79, allowing associated locking members 83 to move out of locking engagement with the shackle 40 (see FIGS. 8B and 8C). The plunger 85 may be spring biased (not shown) to engage the recesses 79, or the plunger may be forced into engagement with the recesses 79 when the shackle 40 of the unlocked padlock is pulled open.

Figure 1:
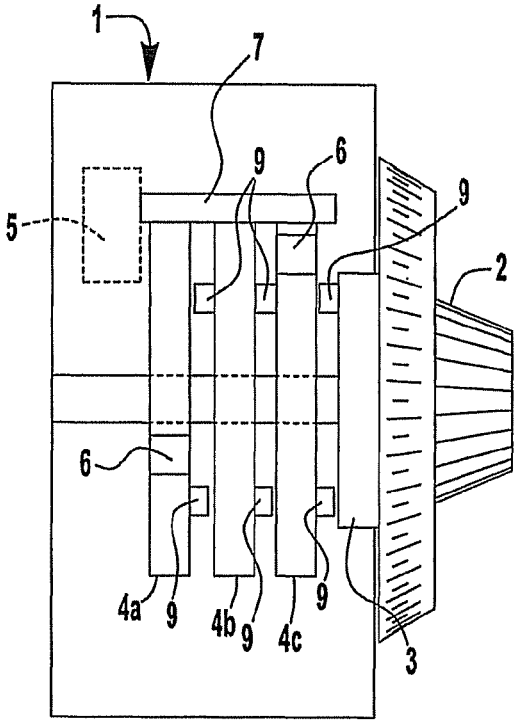
FIG. 1 PRIOR ART
FIG. 1 illustrates a schematic side cross-sectional view of a combination padlock.

According to another inventive aspect of the present application, a single dial combination lock may be provided with an unlocking combination resetting feature, either alone or in combination with other inventive features described in the present application. Such a resetting feature may allow a user to change the unlocking combination to any desired series of dial positions, for example, to prevent access by an individual who knows the previous combination, or to change the combination to a series of numerical positions that may be more easily remembered by that user (e.g., a birth date or some other significant numerical combination). In one embodiment, a combination lock includes a series of cams each having a lock releasing portion (for example, a portion having a notch for receiving a corresponding latch or fence or other such unlocking feature) and a cam inter-engaging portion (for example, a portion having a detent for engaging the detent of an adjacent cam). The lock releasing portions and cam inter-engaging portions may (but need not) be similar to those shown in the embodiment of FIG. 1 and described above. In the exemplary lock, the lock releasing portions may be separable from the cam inter-engaging portions when the combination lock has been unlocked, such that rotation of the combination dial rotates the cam inter-engaging portions while permitting the lock releasing portions to remain in the unlocking position. In this separated condition, the cam inter-engaging portions may be moved to positions corresponding to a desired new unlocking combination, by rotating the combination dial clockwise and counterclockwise to the corresponding incremental dial positions (as described in greater detail above). When the cam inter-engaging portions have been moved to the desired positions, the lock releasing and cam inter-engaging portions may be manipulated to re-engage each other, such that the unlocking position (in which unlocking features, such as notches, align with the latch or fence) is made to correspond with the new unlocking combination.

Many different mechanisms or configurations may be used for selective engagement and disengagement of a lock releasing portion and a cam inter-engaging portion of a cam. For example, lock releasing and cam inter-engaging portions may be engaged or disengaged by opposed frictional surfaces, fasteners, or gear teeth. In one embodiment, a single dial combination lock includes a set of cams, with each cam having a lock releasing portion on a wheel and a cam inter-engaging portion on a hub. Each exemplary wheel and hub are engaged for mutual rotation when the wheel and hub are axially aligned. The wheel and hub are disengaged from each other when the wheel is axially separated from the hub. In this axially separated condition, the hubs remain rotationally connected with the combination dial, with the wheels being rotationally separated from the dial. While many different arrangements may be used to axially separate the wheels from the hubs, in one embodiment, a camming member may be provided in the lock body. When the camming member is pivoted to a resetting condition, the camming member axially moves the wheels to disengage the wheels from the hubs.

Many different mechanisms may be utilized to separate a lock releasing portion or wheel from a cam interengaging portion or hub for resetting a combination code, including, for example, externally manipulable buttons, levers, or other such components, or a linkage between the lock shackle and the cam wheels enabled by positioning the shackle in a specific orientation. In one embodiment, to prevent inadvertent or unauthorized changes to the unlocking combination, a separate component, such as, for example, a key or other such tool, may be used to separate the cam wheels from the hubs. While a key may be inserted through a keyhole in the lock body to engage a mechanism for separation of the wheels and hubs, the lock body may instead be configured to receive an authorized key or tool through the shackle hole for the short leg of the shackle, thereby limiting this code changing access to the unlocked condition (when the shackle has been withdrawn). As such, both the unlocking combination and the tool may be required to change the unlocking combination.

Figure 3C:
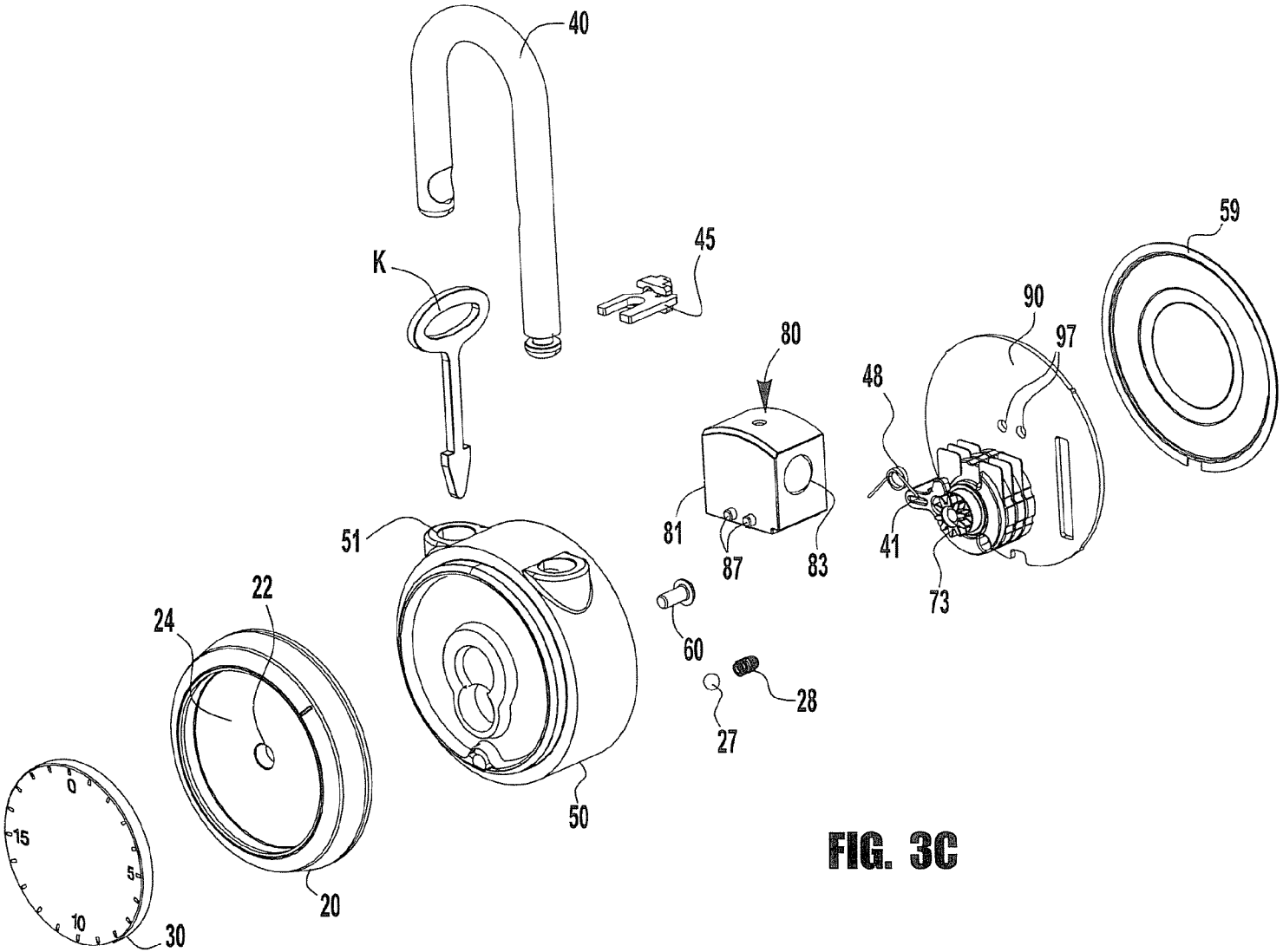
FIG. 3C illustrates another partially exploded front perspective view of the combination padlock of FIG. 2.
Figure 3D:
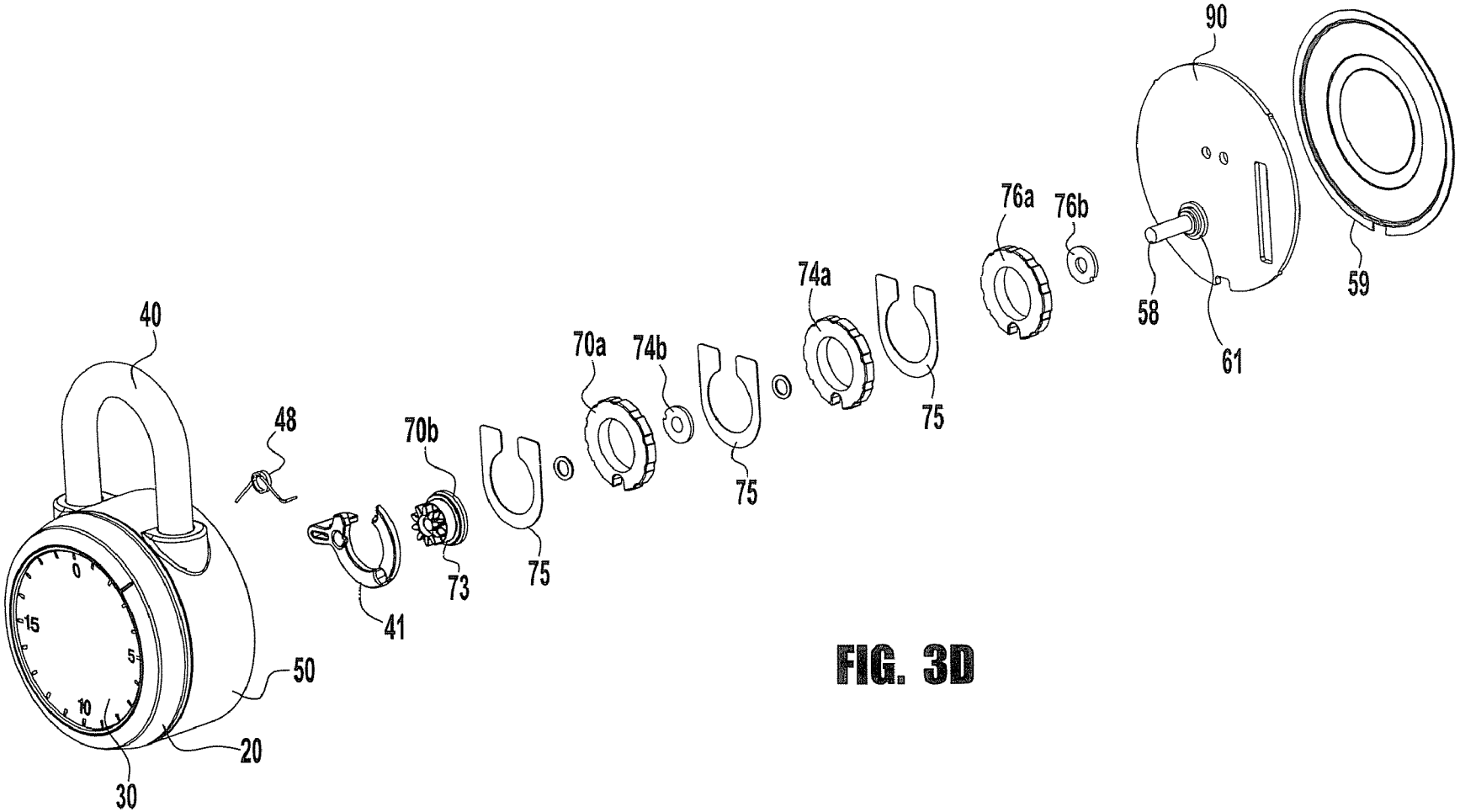
FIG. 3D illustrates yet another partially exploded front perspective view of the combination padlock of FIG. 2.
Figure 3E:
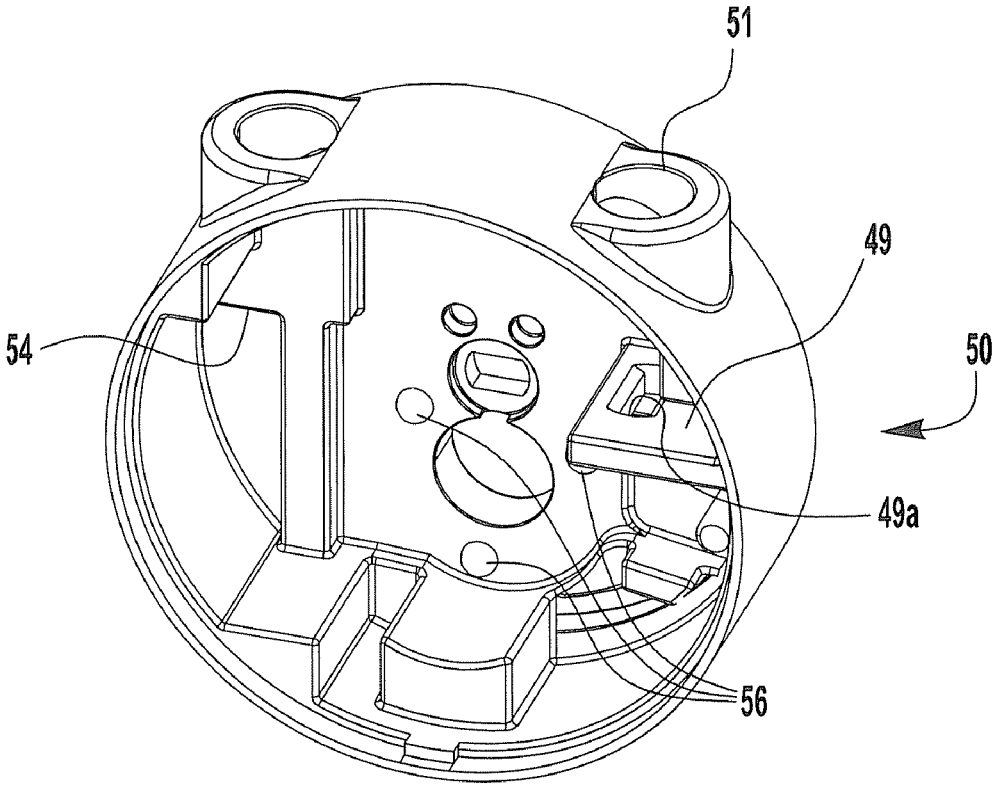
FIG. 3E illustrates a rear perspective view of the lock body of the combination padlock of FIG. 2.
Figure 3F:
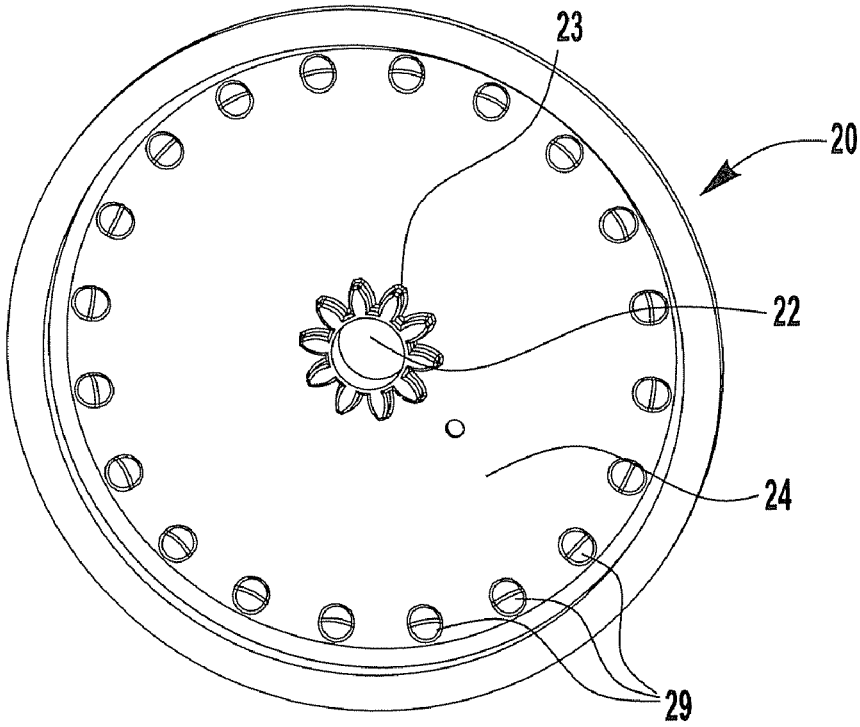
FIG. 3F illustrates a rear perspective view of the dial of the combination padlock of FIG. 2.
Figure 3G:
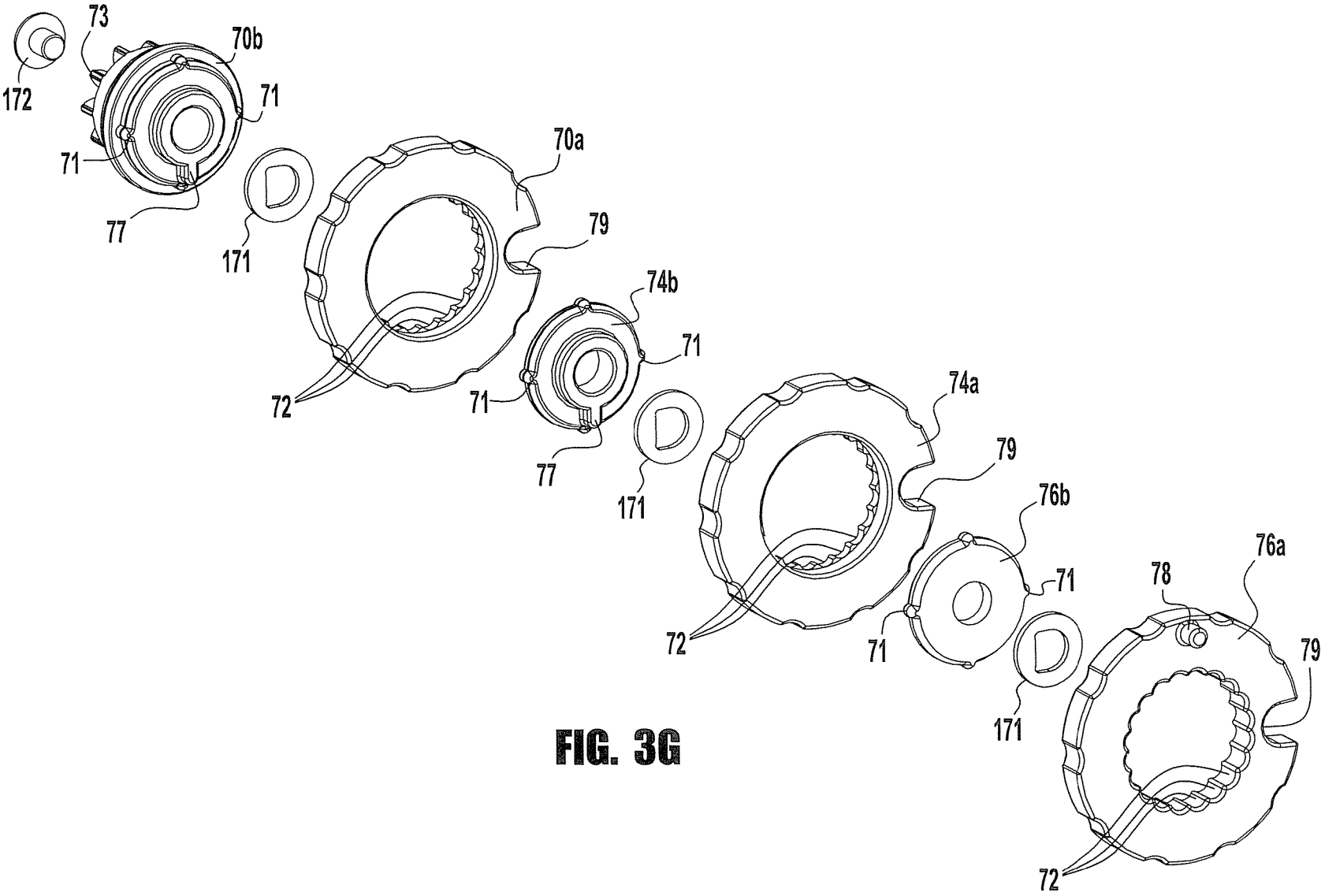
FIG. 3G is an exploded perspective view of the cam subassemblies of the combination padlock of FIG. 2.
Figure 4B:
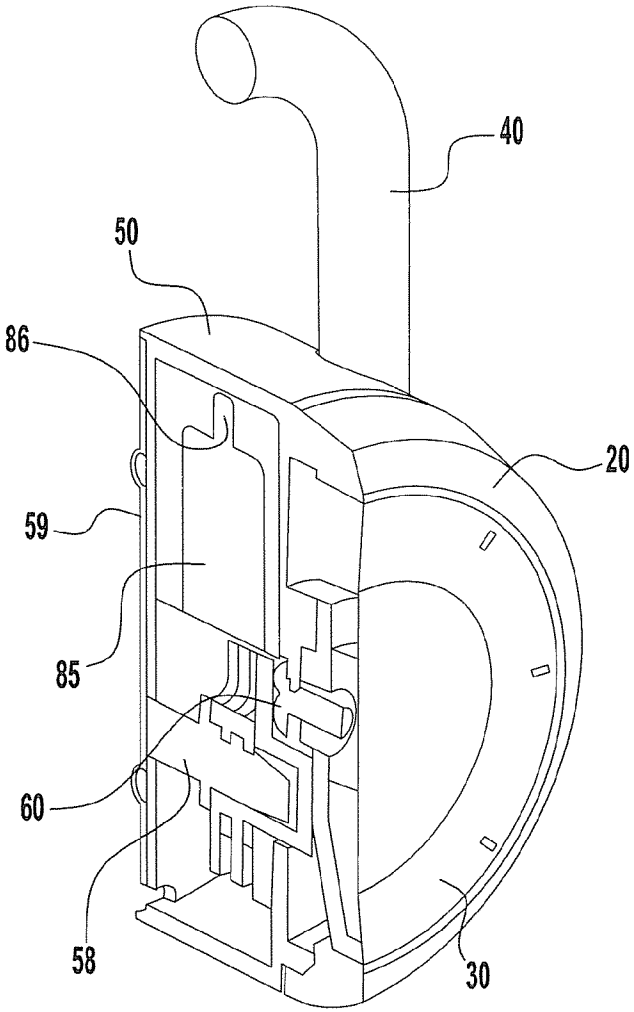
FIGS. 4A and 4B illustrate left and right side cross-sectional perspective views of a combination padlock.
Figure 4A:
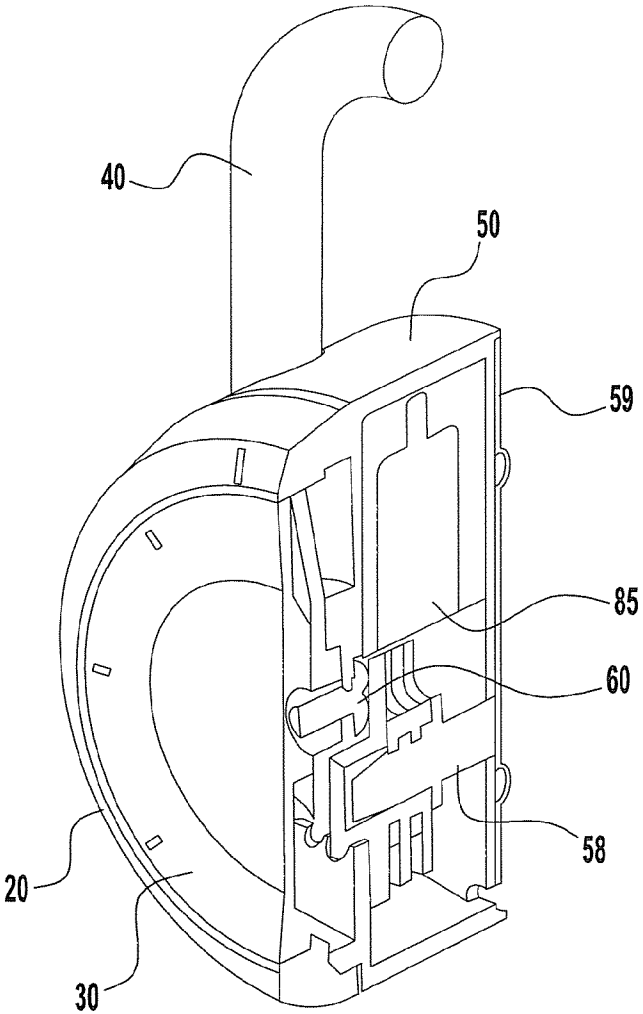
Figure 5:
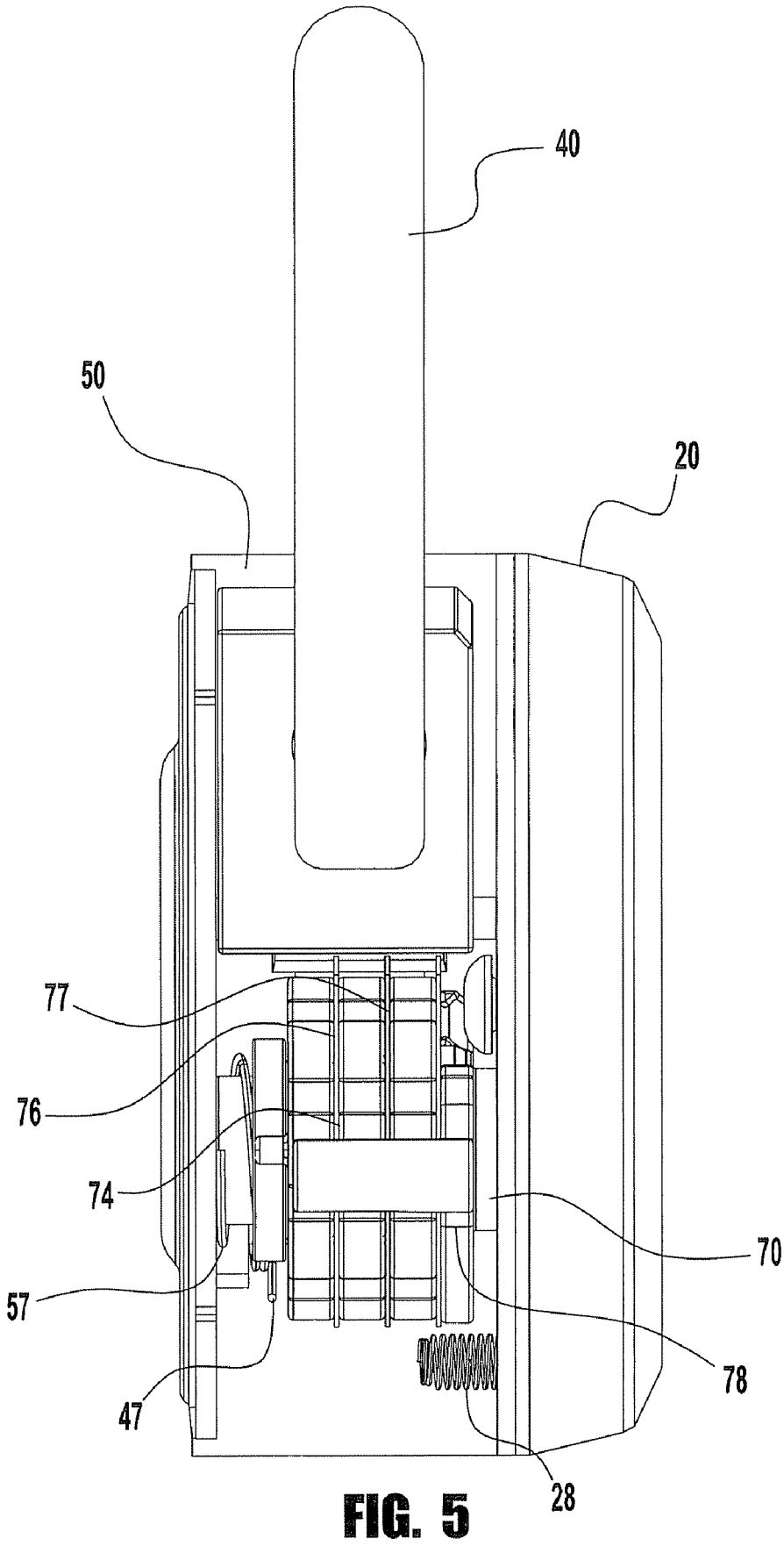
FIG. 5 illustrates a left side view of a combination padlock, with the lock body shown in phantom to illustrate additional features of the padlock.
Figure 7:
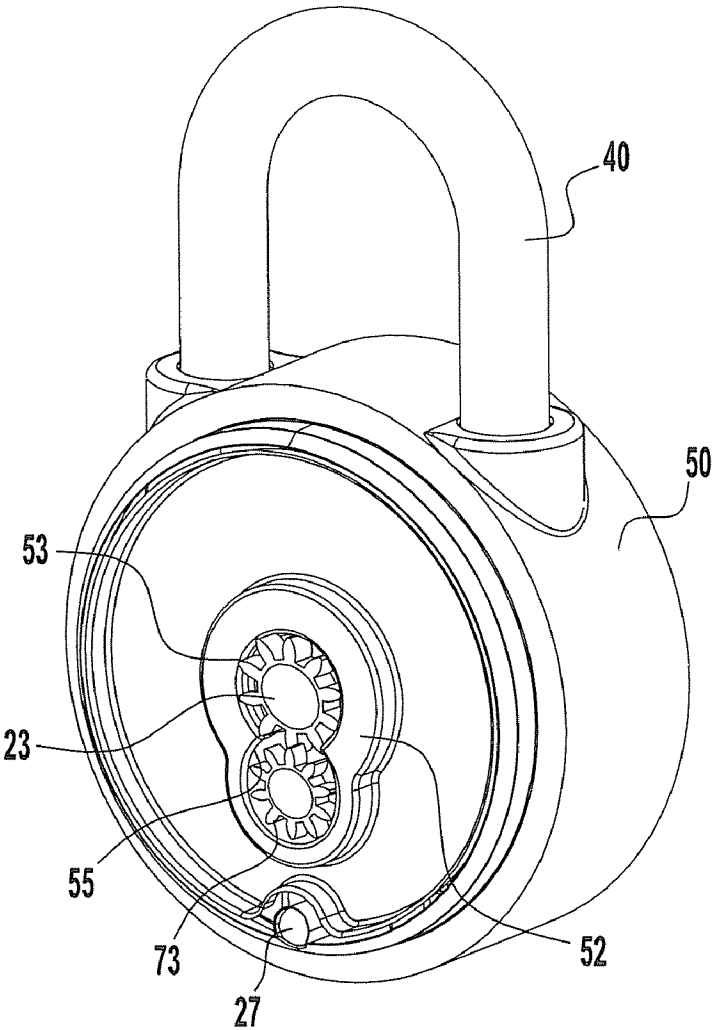
FIG. 7 illustrates a front cross-sectional perspective view of a combination padlock.
Figure 6:
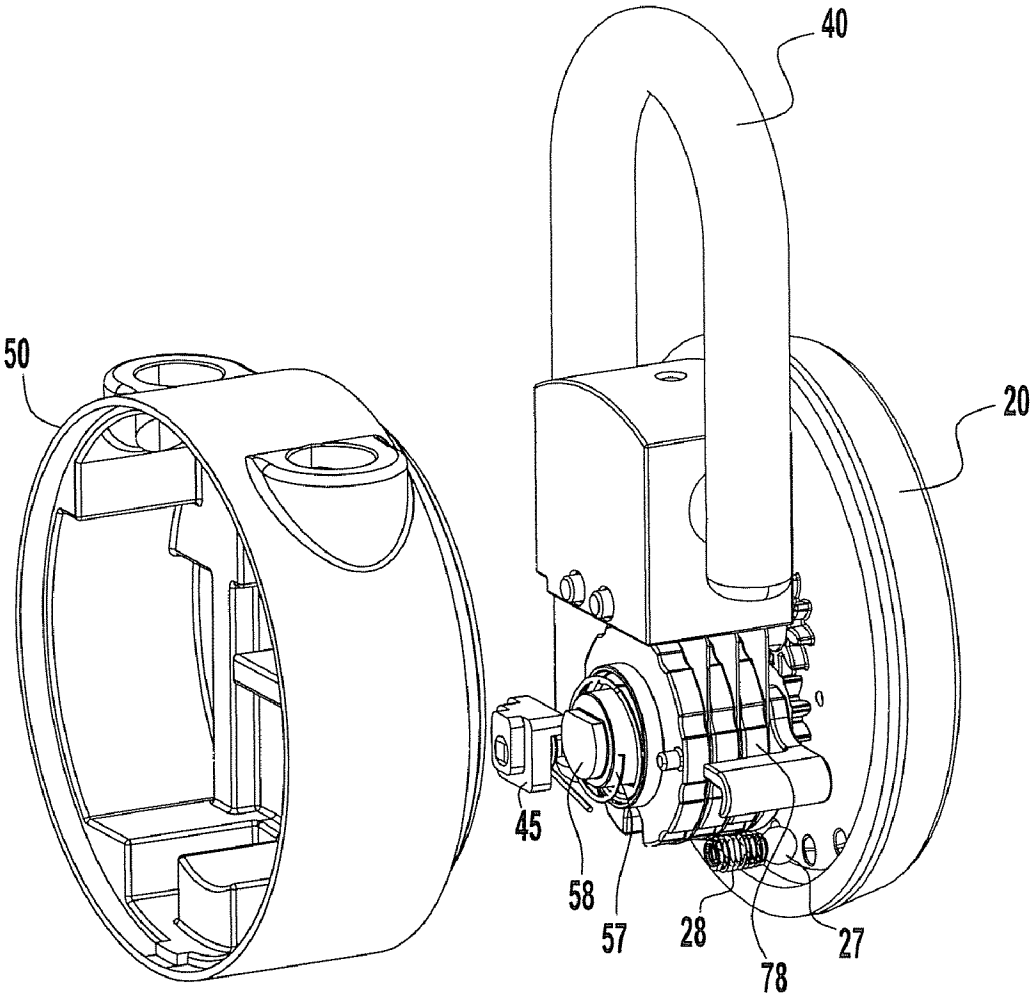
FIG. 6 illustrates a left side perspective view of a combination padlock, with the lock body and locking subassembly shown in phantom to illustrate additional features of the padlock.
Figure 9A:
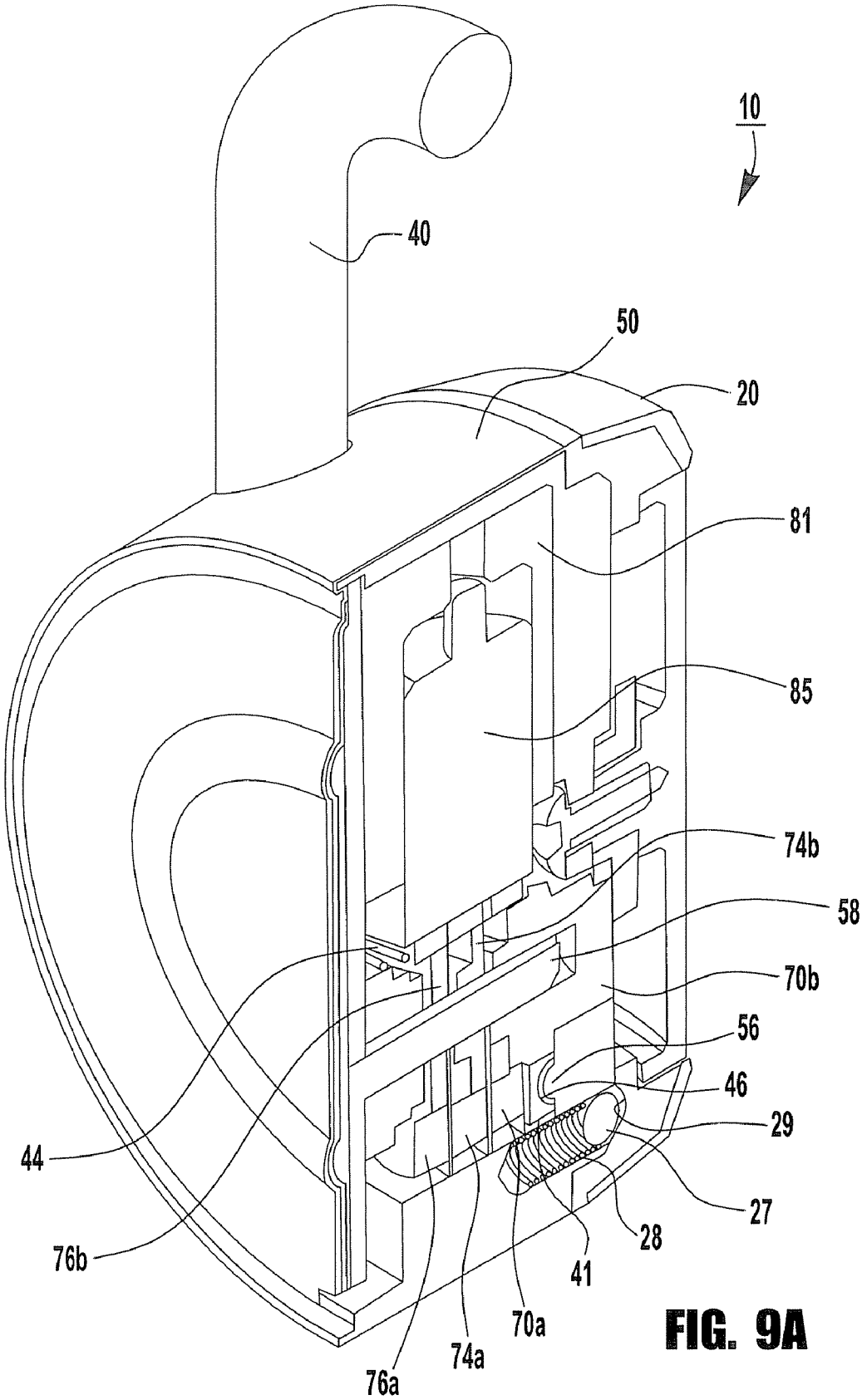
FIG. 9A illustrates a right side cross-sectional perspective view of the combination padlock of FIG. 2, shown in an unlocking condition.
Figure 10:
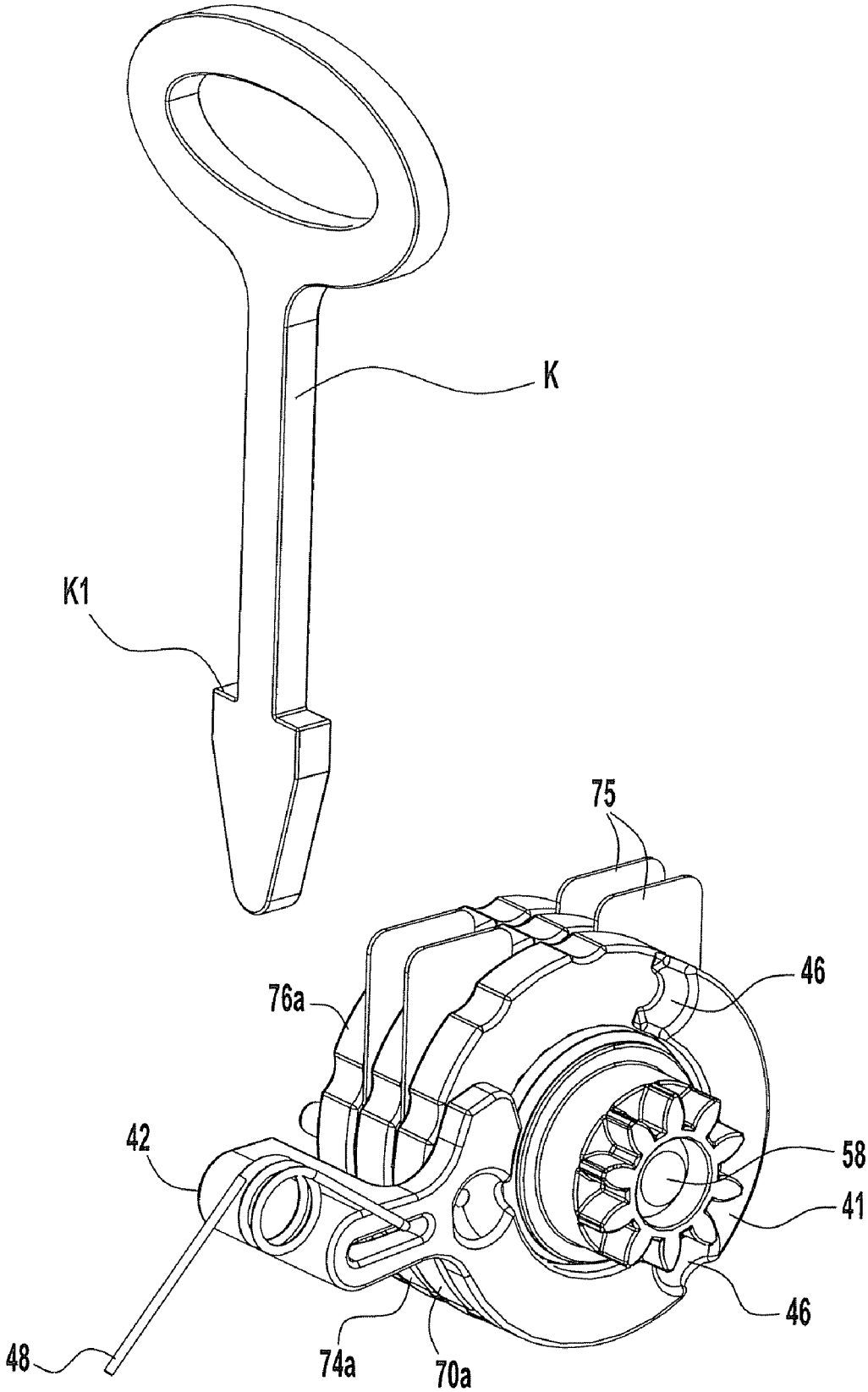
FIG. 10 illustrates a perspective view of the combination resetting arrangement of the combination padlock of FIG. 2.

In the illustrated single dial combination lock 10, each cam 70, 74, 76 includes a wheel 70*a*, 74*a*, 76*a* having a notch or recess 79, and a hub 70*b*, 74*b*, 76*b* having inter-engaging detents 77. As shown in FIG. 3G, the exemplary wheels 70*a*, 74*a*, 76*a* and hubs 70*b*, 74*b*, 76*b* are rotationally connected by radially extending projections 71 of the hubs received in grooves 72 of the wheels (although other configurations for engagement may be provided), such that the wheels may be separated from the hubs (e.g., to move independently of the hubs) by axially moving the wheels 70*a*, 74*a*, 76*a* on the post 58. A spacer 61 (FIGS. 8A-8C) may be assembled with the post 58 to hold the hubs 70*b*, 74*b*, 76*b* in place while allowing axial movement of the wheels 70*a*, 74*a*, 76*a*. The lock 10 also includes a camming member 41 pivotable around or rotatable about the post 58 between a normal condition and a resetting condition. The camming member 41 includes a key engaging portion 42 that is aligned with the short shackle leg hole 51, such that insertion of a proper key or tool K through the short shackle leg hole 51 rotates the camming member from the normal condition to the resetting condition. In the normal unlocked condition, as shown in FIGS. 8B and 9A, one or more lock body nubs 56 (see also FIG. 3E) are received in corresponding ramped recesses 46 (see also FIG. 10) in the camming member 41 to maintain disengagement of the camming member 41 from the wheels 70*a*, 74*a*, 76*a*. When the camming member 41 is rotated to the resetting condition, the lock body nubs 56 slide out of the recesses 46, axially forcing the camming member 41 against the wheels 70*a*, 74*a*, 76*a*, which in turn axially separates the wheels from the corresponding hubs 70*b*, 74*b*, 76*b*. As shown, non-rotating shimming plates 75 may be provided between the wheels 70*a*, 74*a*, 76*a* to prevent the wheels from engaging each other and inadvertently rotating with each other. The shimming plates 75 move axially with the wheels 70*a*, 74*a*, 76*a* when the wheels are disengaged and/or engaged with the hubs 70*b*, 74*b*, 76*b*. Additionally, non-rotating spacers 171 may be provided between the hubs 70*b*, 74*b*, 76*b* to prevent the hubs from inadvertently rotating with each other. A spring 48 may be provided to return the camming member 41 to the normal condition when the key K is withdrawn. A cam spring 44 may also be provided to axially move the wheels 70*a*, 74*a*, 76*a* back into engagement with the corresponding hubs 70*b*, 74*b*, 76*b* when the camming member 41 has returned to the normal condition. The spacer 61 may be sized to properly position the cam spring 44. Further, a cap 172 may be assembled into the end of the post 58 and over the end-most hub 70*b* to retain the post 58 and cam set as a subassembly.

As shown, the lock body 50 may be provided with a blocking wall 49 having an opening or aperture 49*a* sized to allow insertion of the key K while preventing full insertion of other such items. Further, the key K may include a tab or prong K1, such that the inserted key K, upon rotation, will be retained against the blocking wall 49 and held in the fully inserted condition against the force of spring 48 to maintain the resetting condition of the camming member 41.

Figure 11:
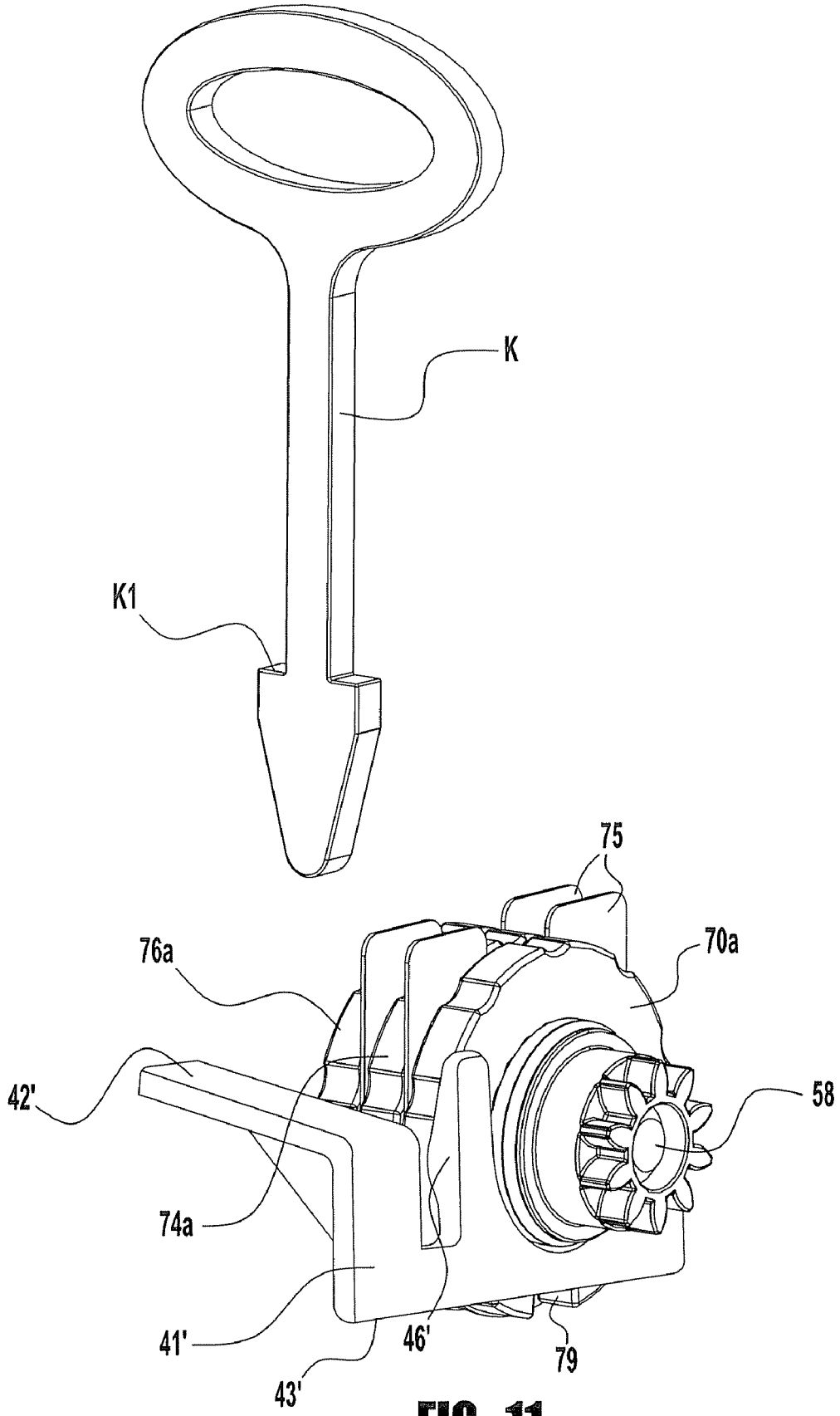
FIG. 11 illustrates a perspective view of another combination resetting arrangement for a combination padlock.

Other key operated mechanisms may be utilized to separate the wheels 70*a*, 74*a*, 76*a* from the corresponding hubs 70*b*, 74*b*, 76*b*. In an alternative embodiment, as shown in FIG. 11, a camming lever 41' is pivotable about a bottom edge 43' between a normal condition and a resetting condition. The camming lever 41' includes a key engaging portion 42' that is aligned with the short shackle leg hole 51, such that insertion of a proper key K through the short shackle leg hole 51 pivots the camming lever 41' from the normal condition to the resetting condition. When the camming lever 41' is pivoted to the resetting condition, camming portions 46' axially force the wheels 70*a*, 74*a*, 76*a* out of engagement with the corresponding hubs 70*b*, 74*b*, 76*b*. The cam spring 44 may provide sufficient biasing force to axially move the wheels 70*a*, 74*a*, 76*a* back into engagement with the corresponding hubs 70*b*, 74*b*, 76*b* and return the camming lever 41' to the normal condition when the key K is withdrawn.

Other features may be provided to assist or facilitate code resetting. In one embodiment, a detent feature is included to provide a user with a positive identification of the position of the combination dial, so that the new unlocking combination may be accurately set as desired. In the illustrated embodiment, a ball bearing 27 is biased by spring 28 (see FIGS. 3C and 9A) into a corresponding recess 29 in each incremental position of the combination dial 20 (FIG. 3F), thereby providing a user with a tactile cue that the dial 20 has reached an exact numerically identifiable rotational position. While the illustrated embodiment is shown with twenty recesses 29 to correspond with twenty rotational positions (for example, positions "0" through "19"), any number of increments may be used (with the ball bearing and recesses sized accordingly).

While many different types of locking mechanisms or locking members may be utilized, in one embodiment, a locking mechanism includes locking members (such as, for example, balls, pins, poppets or other such components) that move in and out of locking engagement with both legs of a shackle when the padlock is locked and unlocked, respectively. While many different locking members may be used, in one embodiment, locking ball members engage corresponding recesses in the shackle legs to maintain the shackle in a locked condition. This locking ball engagement with both shackle legs may, for example, reduce the padlock's susceptibility to unauthorized access by rapping or shimming the shackle. According to another inventive feature of the present application, a locking mechanism, such as the dual ball locking member arrangement described herein, may be provided as a self-contained subassembly, which may, for example, assist in assembly or maintenance of the padlock.

Figure 9B:
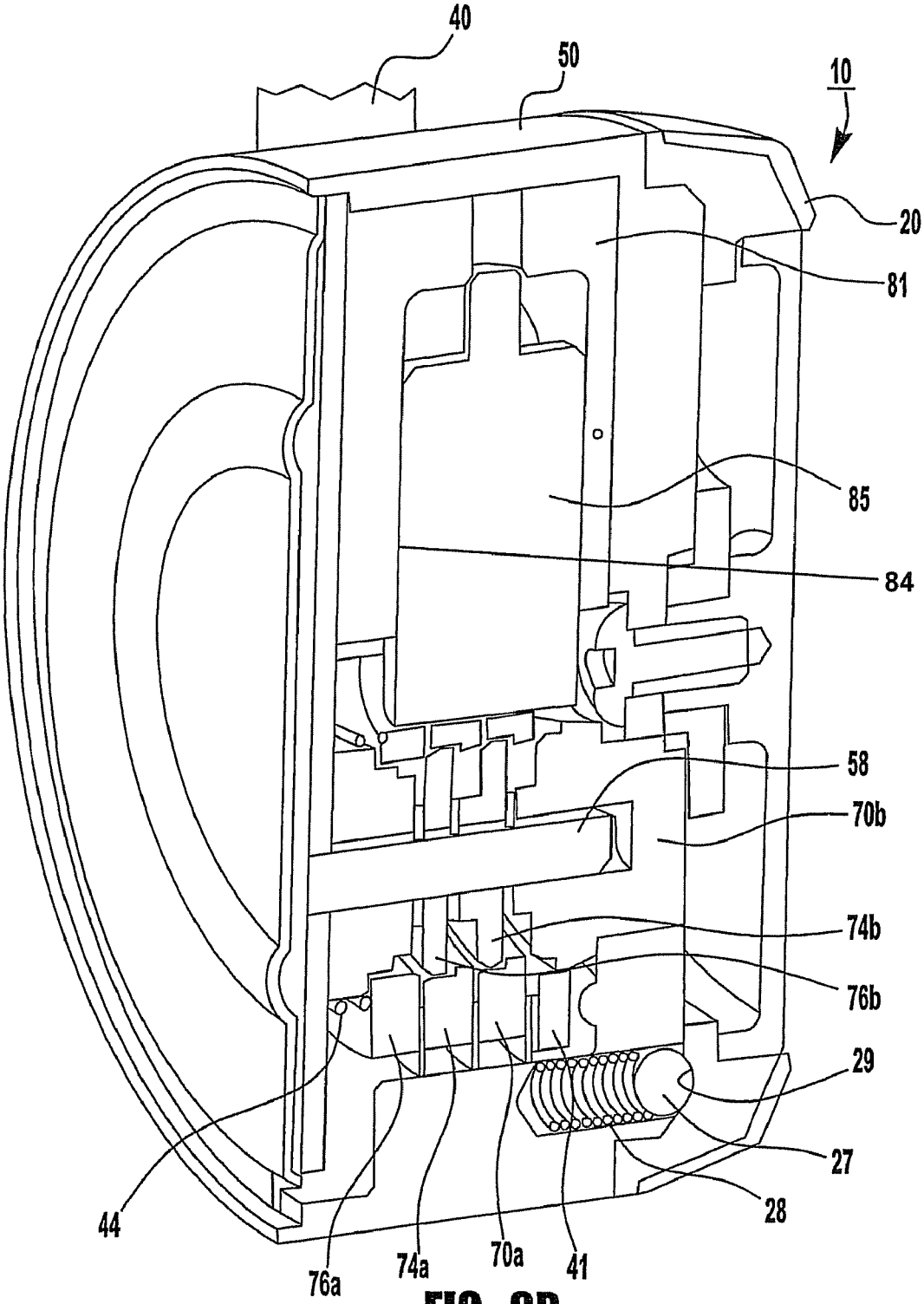
FIG. 9B illustrates a right side cross-sectional perspective view of the combination padlock of FIG. 2, shown in combination resetting condition.

In the illustrated embodiments, the padlock 10 includes a locking subassembly 80 configured to be installed in the lock body 50 between the legs of the shackle 40. As shown in FIG. 3C, the exemplary locking subassembly 80 includes a housing 81 for containment of these locking mechanism components as a self-contained subassembly. The locking subassembly 80 may be secured within the lock 10 by posts 87 extending from the housing 81, to engage corresponding openings 97 in a base plate 90 within the lock body 50 (see FIG. 3C). Locking members 83 (which may, but need not, be ball-shaped members) within the housing 81 are aligned with, and permitted to extend from, openings 82 in the housing 81 for engagement of the locking members 83 with the shackle 40. The subassembly 80 further includes a plunger 85 disposed within the housing 81 between the locking members 83. The plunger 85 extends through a lower opening 84 in the housing 81 (see FIGS. 8A and 9B) for engagement of the plunger 85 with the cams 70, 74, 76.

The plunger 85 includes ramped surfaces that engage the locking members 83. When the locking mechanism is in a locked condition, the outer periphery of one or more of the cams 70, 74, 76 forces the plunger 85 upward, such that a wider portion of the plunger 85 forces the locking members 83 outward into locking engagement with the shackle 40. When the locking mechanism is in an unlocked condition, the plunger 85 is permitted to extend into engagement with the recesses 79 of the cams 70, 74, 76, causing a narrower portion of the plunger to align with the locking members 83. This allows the locking members 83 to disengage from the shackle 40, releasing the shackle for withdrawal from the lock body 50. The locking subassembly 80 may further include biasing members 88, such as springs, between the plunger 85 and the posts 87 to bias the plunger into a locking position for forcing the lock members 83 toward engagement with the shackle 40. The plunger 85 may additionally extend into an upper opening 86 in the housing 81, and shown in FIGS. 9A and 9B, which may further stabilize or align the plunger 85 within the housing 81.

According to another inventive aspect of the present application, a combination lock may be provided with a cam misalignment or "upset" feature which rotates one or more of the dial cams from an aligned unlocked condition to a misaligned condition or locked condition when the shackle (or other such latch) is returned to a locked condition. In one embodiment, a component assembled with the shackle is configured to engage (either directly or indirectly) one or more of the dial cams when the shackle is retracted back into the lock body, causing the cams to rotate or "scramble" out of the aligned, unlocked condition. In one such embodiment, the upset feature may be associated with a shackle stop, assembled with the long shackle leg to retain the long end of the shackle within the lock body when the lock is unlocked.

In the illustrated embodiment, as shown in FIGS. 8A-8C, a shackle stop 45 is assembled with the long leg of the shackle 40 for engagement with a retaining surface 54 (FIG. 3E) of the lock body 50 when the shackle 40 is pulled open, to prevent separation of the shackle 40 from the lock body 50. An upset member 47 is assembled with the shackle stop 45 and positioned to engage an outer detent or catch 78 on cam 76. In the illustrated embodiment, the upset member 47 is a torsion spring. When the shackle 40 is pulled open, the upset member 47 rotates or bends upon engagement with the catch 78, allowing the upset member 47 and the long end of the shackle to move past the catch 78. When the shackle 40 is pushed back into the lock body 50, engagement between the upset member 47 and the catch 78 (which is held fixed due to engagement between the plunger 85 and the cams) causes the upset member 47 to twist, thereby maintaining engagement between the upset member 47 and the catch 78 and generating stored energy within the upset member 47 as the upset member becomes spring-loaded against the catch. When the shackle 40 reaches the locked position, the locking members 83 re-engage the shackle 40 and the plunger 85 disengages from the cams 70, 74, 76, such that the spring-loaded upset member 47 applies a rotational force to the cam 76 to misalign or upset the cams 70, 74, 76.

Additional features may be provided with a combination lock according to other inventive aspects of the present application. As one example, a light source, such as a light emitting diode (LED) may be provided in a combination lock to illuminate a stationary face of the combination lock. In one such embodiment, the stationary face is provided in a transparent or translucent material to allow the front of the face to be illuminated from within the padlock. As another example, a lock may be provided with a magnetic member, for example, attached to a back plate of the lock for attaching the lock to a locker when it is unlatched. As another example, a lock may be configured for customization of a stationary face, by using replacement face plates with varying patterns, contours, shades, and textures, or by adapting a lock to receive a patterned disk behind a transparent face plate.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A combination lock comprising:

a lock body having front and rear sides and an outer peripheral wall extending from the front side to the rear side, wherein the front side of the lock body includes a stationary face having one or more rotational position indicia;

a shackle having long and short legs receivable in corresponding first and second shackle openings in the lock body and axially moveable between a retracted position and an extended position, the short leg being withdrawn from the lock body when in the extended position;

a locking mechanism movable between a locked condition and an unlocked condition, the locking mechanism comprising a plurality of cams rotatable about a post, wherein rotation of each of the cams to an unlocking orientation permits movement of the locking mechanism to the unlocked condition, wherein when the locking mechanism is in the unlocked condition, the shackle is moveable from the retracted position to the extended position; and a dial secured to the front side of the lock body and rotatable about a central axis spaced apart from an entirety of the post, the dial including an outer ring portion surrounding the lock body face and rotatable with respect to the face, and a locking mechanism engaging portion disposed between the face and the rear side of the lock body, wherein successive rotation of the dial to a series of one or more predetermined rotational positions causes the locking mechanism to move from the locked condition to the unlocked condition.

2. The combination lock of claim 1, wherein each of the plurality of cams comprises a hub interlocking with a corresponding wheel for mutual rotation therewith.

3. The combination lock of claim 2, further comprising a camming member disposed in the lock body, the camming member being configured to be pivoted from a normal condition to a resetting condition by insertion of a tool into the lock body, to axially move the plurality of wheels along the post and out of interlocking engagement with the corresponding hubs, such that subsequent rotation of the dial selectively adjusts the rotational position of each of the plurality of wheels with respect to the corresponding hub.

4. The combination lock of claim 2, further comprising a comprising member disposed in the lock body, the camming member being pivotable around the post from a normal condition to a resetting condition to axially move the plurality of wheels along the post and out of interlocking engagement with the corresponding hubs, such that subsequent rotation of the dial selectively adjusts the rotational position of each of the plurality of wheels with respect to the corresponding hub.

5. The combination lock of claim 1, wherein the locking mechanism further comprises a sliding member having a ramped surface configured to hold a locking member in locking engagement with a corresponding notch in the shackle when the sliding member is in a locked position, and further configured to allow the locking member to disengage from the shackle when the sliding member is in an unlocked position, to permit movement of the shackle from the retracted position to the extended position.

6. The combination lock of claim 5, wherein the locking mechanism further comprises a plurality of cams rotatable about a post, wherein when each of the cams is rotated to an unlocking orientation, unlocking features disposed on each of the plurality of cams align with the sliding member to permit movement of the sliding member from the locked position to the unlocked position.

7. The combination lock of claim 1, wherein the lock body face comprises a face plate secured to a central portion of the lock body.

8. A combination lock comprising:

a lock body;

a shackle having long and short legs receivable in corresponding first and second shackle openings in the lock body and axially moveable between a retracted position and an extended position, the short leg being withdrawn from the lock body when in the extended position;

a locking mechanism disposed in the lock body, the locking mechanism comprising a locking member for lockingly engaging the shackle, and a plurality of interengaging hubs each interlocking with a corresponding wheel for mutual rotation therewith about a post, wherein when each of the plurality of wheels is rotated to an unlocking orientation, the locking member is permitted to disengage the shackle to permit movement of the shackle from the retracted position to the extended position;

a dial secured to the lock body for selective rotation of the plurality of hubs; and a camming member disposed in the lock body, the camming member being configured to be pivoted from a normal condition to a resetting condition by insertion of a tool into the lock body, to axially move the plurality of wheels along the post and out of interlocking engagement with the corresponding hubs, such that subsequent rotation of the dial selectively adjusts the rotational position of each of the plurality of wheels with respect to the corresponding hub.

9. The combination lock of claim 8, wherein the camming member is pivotable around the post.

10. The combination lock of claim 9, wherein when the camming member is pivoted to the resetting condition, interengaging surfaces of the lock body and the camming member axially move the camming member along the post.

11. The combination lock of claim 10, wherein the lock body interengaging surfaces comprise one or more nubs, and the camming member interengaging surfaces comprise ramped surfaces.

12. The combination lock of claim 8, wherein the camming member is pivotable about an edge of the camming member to axially move a camming portion of the camming member into engagement with one of the plurality of wheels.

13. The combination lock of claim 8, wherein the camming member is configured to be pivoted from the normal condition to the resetting condition by insertion of a tool into the second shackle opening when the shackle is in the extended position.

14. The combination lock of claim 13, further comprising a blocking wall disposed in the lock body between the second shackle opening and a tool engaging portion of the camming member, the blocking wall having an aperture sized to allow insertion of an authorized tool.

15. A combination lock comprising:

a lock body;

a shackle having long and short legs receivable in corresponding first and second shackle openings in the lock body and axially moveable between a retracted position and an extended position, the short leg being withdrawn from the lock body when in the extended position;

a locking mechanism disposed in the lock body, the locking mechanism comprising a locking member for lockingly engaging the shackle, and a plurality of interengaging hubs each interlocking with a corresponding wheel for mutual rotation therewith about a post, wherein when each of the plurality of wheels is rotated to an unlocking orientation, the locking member is permitted to disengage the shackle to permit movement of the shackle from the retracted position to the extended position;

a dial secured to the lock body for selective rotation of the plurality of hubs; and a camming member disposed in the lock body, the camming member being pivotable around the post from a normal condition to a resetting condition to axially move the plurality of wheels along the post and out of interlocking engagement with the corresponding hubs, such that subsequent rotation of the dial selectively adjusts a rotational position of each of the plurality of wheels with respect to the corresponding hub.

16. The combination lock of claim 15, wherein the camming member is configured to be pivoted from the normal condition to the resetting condition by insertion of a tool into the lock body.

17. The combination lock of claim 15, wherein when the camming member is pivoted to the resetting condition, interengaging surfaces of the lock body and the camming member axially move the camming member along the post.

18. The combination lock of claim 17, wherein the lock body interengaging surfaces comprise one or more nubs, and the caroming member interengaging surfaces comprise ramped recesses.

19. A combination lock comprising:

a lock body;

a shackle having long and short legs receivable in corresponding first and second shackle openings in the lock body and axially moveable between a retracted position and an extended position, the short leg being withdrawn from the lock body when in the extended position;

a locking mechanism disposed in the lock body, the locking mechanism comprising:

a locking member;

a sliding member axially movable with respect to the locking member and having a ramped surface configured to hold the locking member in locking engagement with a corresponding notch in the shackle when the sliding member is in a locked position, and further configured to allow the locking member to disengage from the shackle when the sliding member is in an unlocked position, to permit movement of the shackle from the retracted position to the extended position; and a plurality of cams rotatable about a post, wherein when each of the plurality of cams is rotated to an unlocking orientation, unlocking features disposed on each of the plurality of cams align with the sliding member to permit axial movement of the sliding member from the locked position to the unlocked position; and a dial secured to the lock body for selective rotation of the plurality of cams.

20. The combination lock of claim 19, further comprising an upset member assembled with the long leg of the shackle, the upset member being configured to be spring-loaded against one of the plurality of cams as the shackle is moved from the extended position to the retracted position, such that the spring-loaded upset member imparts a rotational force on the one of the plurality of cams when the shackle reaches the retracted position to rotate the plurality of cams out of the unlocking orientation.

21. The combination lock of claim 19, wherein when the sliding member is in the unlocked position, the sliding member is configured to secure the plurality of cams in the unlocking orientation until the shackle is returned to the retracted position.

22. The combination lock of claim 19, further comprising a locking subassembly housing configured to retain the locking member and the sliding member as a self-contained locking subassembly.

23. A lock comprising:

a lock body;

a shackle having long and short legs receivable in corresponding first and second shackle openings in the lock body and axially moveable between a retracted position and an extended position, the short leg being withdrawn from the lock body when in the extended position;

a locking mechanism disposed in the lock body, the locking mechanism comprising:

a locking member;

a sliding member axially movable with respect to the locking member and having a ramped surface configured to hold the locking member in locking engagement with a corresponding notch in the shackle when the sliding member is in a locked position, and further configured to allow the locking member to disengage from the shackle when the sliding member is in an unlocked position, to permit movement of the shackle from the retracted position to the extended position;

a first rotatable mechanism, rotatable about a first axis in response to user manipulation of the lock; and a second rotatable mechanism, rotatable about a second axis spaced apart from the first axis, in response to rotation of the first rotatable mechanism, the second rotatable mechanism including a recess that permits axial movement of the sliding member from the locked position to the unlocked position when the recess is aligned with the sliding member.

24. The lock of claim 23, wherein the first and second axes are non-parallel to the long and short shackle legs.

25. The lock of claim 23, wherein the first rotatable mechanism comprises a manually rotatable dial, and the second rotatable mechanism comprises a plurality of rotatable cams.

* * * * *

UNITED STATES PATENT AND TRADEMARK OFFICE

CERTIFICATE OF CORRECTION

PATENT NO. : 7,934,405 B2
APPLICATION NO. : 12/015185
DATED : May 3, 2011
INVENTOR(S) : Gary Burmesch et al.

It is certified that error appears in the above-identified patent and that said Letters Patent is hereby corrected as shown below:

Claim 18, Column 12, line 27, after "the" delete the word "caroming" and insert --camming--.

Signed and Sealed this
Fourteenth Day of June, 2011

David J. Kappos

David J. Kappos
*Director of the United States Patent and Trademark Office*